US006516737B2

(12) United States Patent
Le Coz et al.

(10) Patent No.: US 6,516,737 B2
(45) Date of Patent: Feb. 11, 2003

(54) AUTONOMOUS CONTAINER SHIP

(75) Inventors: Daniel Le Coz, Ploemeur (FR); Jean-Yves Le Lan, Ploemeur (FR); Daniel Person, Coueron (FR); Christian Fournier, Issy les Moulineaux (FR); Sylvain Le Rouzic, Lorient Naval (FR); Olivier De Smirnoff, Port-Louis (FR)

(73) Assignee: Etat Francais Represente par le Delegue General pour l'Armement, Armees (FR)

( * ) Notice: Subject to any disclaimer, the term of this patent is extended or adjusted under 35 U.S.C. 154(b) by 0 days.

(21) Appl. No.: 09/842,063

(22) Filed: Apr. 26, 2001

(65) Prior Publication Data

US 2002/0069806 A1 Jun. 13, 2002

(30) Foreign Application Priority Data

Apr. 26, 2000 (FR) ..... 00 05309

(51) Int. Cl.[7] ..... B63B 25/00

(52) U.S. Cl. ..... 114/72; 114/73

(58) Field of Search ..... 114/72, 73

(56) References Cited

U.S. PATENT DOCUMENTS 3,823,681 A * 7/1974 Cushing et al. ..... 114/260
5,359,952 A 11/1994 Klundt et al. ..... 114/272

* cited by examiner

*Primary Examiner*—Jesus D. Sotelo
(74) *Attorney, Agent, or Firm*—Oliff & Berridge, PLC

(57) ABSTRACT

The present invention relates in particular to an autonomous container ship of the type having a hull, propulsion means, and loading and unloading means, characterized by having ballasting means and means (11, 12, 5) for varying the air draft without changing the draft.

12 Claims, 6 Drawing Sheets

AUTONOMOUS CONTAINER SHIP

The invention relates to an autonomous container ship for carrying containers from large ports equipped with loading and unloading means to small ports lacking such equipment.

"Containers" means not only standard containers but also intermodal transportation units, particularly mobile bodies and trailers, as well as the capability of loading bulk freight into the holds.

In particular, the invention relates to a range of small and large ships for carrying freight from small ports to other small ports by containers.

This range is composed of ships for carrying a maximum of two, four, ten, twenty, thirty, fifty, or a hundred containers.

One principal feature of the ship is its full autonomy, so that it can load and/or unload containers in a port not equipped with handling means and with a shallow draft, less than 4 meters.

Freight transport is indeed one of the major drivers of our market economy.

The globalization of international trade, the development of "just-in-time" policies, and the increasing demand for responsiveness are factors that spur land transport, developing expensive highway systems that harm the environment.

The range of ships according to the invention arose from this analysis with the concern of developing complementarity between land transport and sea-river transport.

The goal is to provide sea links from leading or second-line ports to serve the many river ports that are underserved or not served at all with freight transport.

The objective is for trucking companies to pick up the containers from these ports for local distribution to minimize land transport miles.

One of the goals of the present invention is to provide the trucking company with a mobile "sea-river highway" infrastructure matching that available on the highway network.

A second goal is to increase the responsiveness of sea-road transportation by carrying small quanties at greater frequencies.

A third goal is to provide a sea-river service with substantial handling self-sufficiency, an optimized pier-to-pier route, and loading/unloading systems fitted to these constraints. This goal implies the ability to carry a large payload relative to the displacement of the ship.

A fourth goal is to provide transportation under service conditions and at mileage costs comparable to road transportation.

There are a number of container ships with a large container-carrying capacity and deep draft, such as those described on pages 315, 338, and 341 of Jane's Intermodal Transportation. One of these large container ships is the Alianca Brasil with a capacity of 2200 containers, speed 20.4 knots, length 202.23 meters, and draft 12.02 meters. One of the smallest of these container ships is the Hera, capacity 198 containers, speed 12.5 knots, length 88 meters, and draft 4.6 meters.

These container ships usually unload in port terminals equipped with a great deal of handling equipment. The ports able to receive existing container ships are few in number and cannot deliver goods close to their utilization point.

Moreover, they are unable to sail up most estuaries and definitely cannot navigate in canals because their draft and air draft are too large—the latter due particularly to the wheelhouse, the handling equipment and, where present, radar support masts.

In addition, U.S. Pat. No. 5,359,952 is known, describing a container ship able to move on rivers, with a retractable pilot house, and a retractable crane located on a deck separating two holds.

However, such a ship has two major drawbacks, namely its inability to sail at sea and possible loss of space due to the presence of the handling equipment between the two holds.

The goal of the invention is to remedy these drawbacks by providing an autonomous container ship able to sail on the open seas as well as in rivers or canals, and having all or some of the following options:

- it can sail along wide canals and at sea,
- it allows for intermodal transport, namely at sea and in rivers or canals from river ports, with no financial outlay for dock cranes or long wharves,
- it makes sea-river intermodal transport economically competitive (by grouping transportation and loading activities),
- it optimizes the critical size of the load (financial aspect) and the compactness of the ship in a canal (within the canal width)
- it avoids reloading containers onto a sea-going vessel at the end of the river part of the route,
- it is possible to complete loading, on an outsize deck, for the sea-going part of the route,
- it provides service as complete as that of a trucker but uses the sea-river method.

An autonomous container ship according to the invention of the type having a hull, a bridge, propulsion means, at least one hold for receiving containers, means for handling these containers, ballasting means, and means for varying the air draft being in particular means for retracting the bridge, characterized by having watertight hatch covers and by the handling means being comprised of a portal crane moving on rails located on either side of said hold, and by having means for retracting this portal crane into a special area of the hold, said area also being able to receive containers when said portal crane is not stowed.

According to a particular feature, the holds are surrounded by coaming to prevent their being flooded and said rails are disposed on said coaming.

According to another feature, a lift retracts said handling means and part of said rails.

According to another feature, said special area is disposed aft of the bridge in the stern of the ship.

According to another feature, the ship has means for retracting masts supporting the radar detection means such as a radar.

According to another feature, the ship has watertight hatch covers able to support the containers loaded on deck; said watertight hatch covers can be manipulated by the handling means.

According to a particular feature, the ballasting means are able to compensate for the variation in draft and associated air draft depending on the degree of loading of the total cargo allowable in rivers.

According to an additional feature, the ship has a double hull and the ballasting means are tanks disposed between said hulls and supplied with water or not supplied with water by pumps.

According to another feature, the ballasting speed of said ballasting means is at least equal to the container loading or unloading rate with said handling means.

According to a particular feature, the ship has additional flotation devices comprised of for example an inflatable buoy system. These inflatable buoys can be built into the side of the ship to increase flotation inertia thus limiting pitching and rolling of the ship during handling operations.

According to another feature, the ship has pitch stabilizing means that could be comprised of a system transferring solid weights. This solid weight moves in the ship to compensate for container movements during handling operations.

According to another feature, the ship has means for retracting the structures on board the ship that have a large air draft, typically on the order of several meters.

According to another feature, the ship has safety means able to determine the value of the headroom under an obstacle and the value of the ship's air draft as well as either means for displaying information on these values or alarm means when these values are incompatible or means for controlling all or some of said retracting means.

This ship is also characterized by having propulsion means ensuring maneuverability in ports and moving the ship in the forward or rearward directions.

According to another feature, the means retracting the handling means and the special area 15* of hold 2* are disposed on one side of the bridge while the holds for receiving the containers are on the other side of the bridge. Such an arrangement facilitates transport of bulk goods and also permits forward viewing of the ship from bridge 4 when the handling means are not retracted and above special area 15.

The range of ships according to the invention includes ships able to carry between 2 and 150 ISO twenty-foot containers (6.058×2.438×2.591 meters).

These ships are designed along identical architectural principles and can thus be built from modules.

These principles can be chosen for the hull, the engines, container handling, and balancing of the ship.

The hull can be of the monohull type.

According to another embodiment, it can be of the catamaran type or combination type, monohull forward and catamaran in the stem, or the tunnel hull type.

It can be powered by diesel, drive shaft, and screws.

It can also be powered by an active rudder.

According to one embodiment, propulsion is provided by hydrojet.

According to another embodiment, propulsion is provided by pumpjet.

The ship can also be powered by a cycloidal propeller such as that known as "Voith" manufactured by the Voith-Schneider Company.

Propulsion can also be provided by a device known as "pod azimuth" made by the Schottel Company.

The drive can be activated by a diesel engine, by an electric motor, or by a disc motor.

A combination of these various features provides an architectural principle for the range of ships.

Also, the ship must be buildable for a cost giving the investors an alternative to road transport.

To accomplish this, the technological solutions leading to economically viable solutions must have the following features.

The ship must be able to carry a large payload relative to its displacement.

The equipment must be as versatile as possible, implying a common power source for propulsion, storage of the various elements, and handling. The handling means can be used, at least partially, both on board and on land, and the propulsion means provide not only for cruising speed of the ship and appropriate speeds for estuaries, canals, and ports, but also maneuverability in ports. In addition, the ship balancing means can be used in handling operations.

The set of ships according to the invention are fully self-sufficient in the following areas:

- sailing: fast and slow drive and navigation capability in the open sea;
- life on board: quarters for a three- to five-man crew for several days;
- handling: handling means enabling the ship to load and unload containers in unequipped ports;
- balancing: a balancing system provides rolling and pitching stability of the ship while sailing and during the container handling operations.

The invention also relates to an autonomous container ship according to the invention of the type having a hull, a bridge, propulsion means, at least one hold for receiving containers, means for handling these containers, ballasting means, and means for varying the air draft being in particular means for retracting the bridge, characterized by having watertight hatch covers and by the holds being surrounded by coaming to prevent their being flooded, and also by the handling means being comprised of a portal crane movable on rails placed on either side of said hold, said rails being disposed on said coaming and by having means for retracting this portal crane on a smaller deck located behind the bridge in the stern of the ship.

Other advantages and features of the present invention will emerge from the description of several embodiments of the invention referring to the attached drawings, of which:

FIGS. 1 to 5 show general drawings of a ship according to the invention in various configurations, namely:

unladen at sea in FIG. 1, unladen on a river or canal in FIGS. 2 and 3, fully loaded on a river or canal in FIG. 4, fully loaded at sea in FIG. 5, FIGS. 6 and 7 show means for storing the handling means according to the invention.

Figure 1:
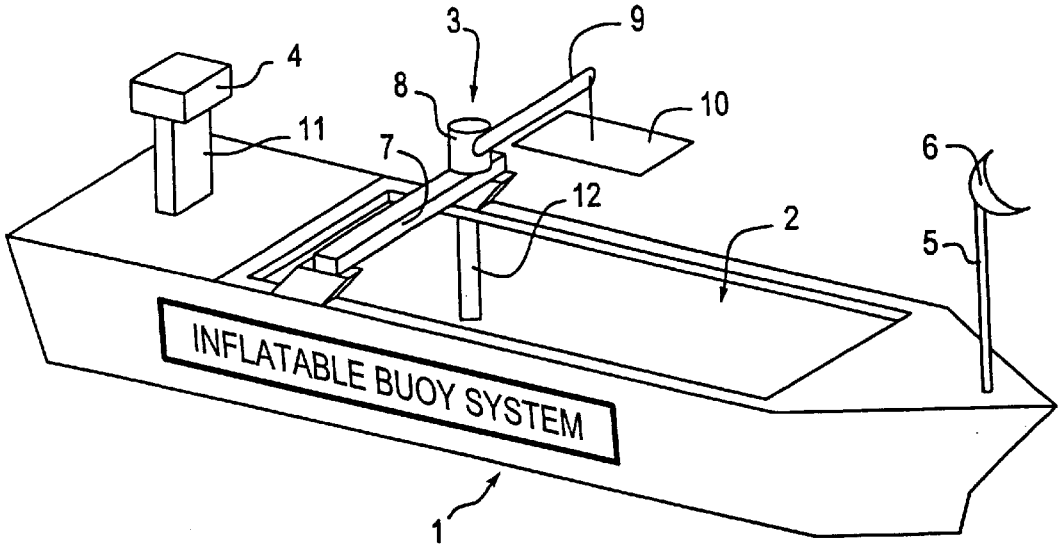
FIGS. 1 to 5 are general drawings of a ship according to the invention in various configurations.

FIG. 1 shows a ship according to the invention unladen and at sea. This ship has a hull 1, at least one hold 2 for receiving containers 13, means 3 for handling said containers, a wheelhouse 4, also called a bridge, and a mast 5 supporting a radar antenna 6.

The container handling means 3 are comprised of a traveling portal crane 7 covering the entire length of container holds 2 and a crane 8 mounted on the traveling crane and able to manipulate the containers on a wharf.

Advantageously, a land handling system is associated with said handling means. These means can for example be comprised of a truck unloaded by the crane or down a ramp.

In addition, a system 14 that limits heeling over while a container is being deposited on the wharf is associated with said handling means.

To keep within the navigation clearance (draft and air draft) in channels, the container ship has:

- devices 11, 12 for retracting elements encumbering the overhead clearance of the ship, which are essential at sea but do not need to be in the up position in channels, specifically the various masts 5, the bridge 4, and the handling means 2,
- ballasting means not shown, dimensioned to balance the river cargo and keep the draft and air draft constant whatever the container load, a special area 15 in hold 2 receives all the handling means (portal/crane+truck) when sailing in rivers or canals to keep within the limits of the latter, a portal crane lift system 12.

This portal crane lift system is simply comprised of a portion of the two longitudinal rails that can be lowered into the hold. The lift mechanism is compact in order not to interfere with the hull portion located below. It can be comprised of a chain system, a hydraulic jack system, or a screw jack system. The two sides can be comprised of two synchronized or mechanically connected mechanisms.

A locking system at the extreme positions completes this installation to relieve the lifting motors during rest phases.

When the lift is locked into the up position, it can support the crane portal, the hatch covers of the special hold, and the containers on deck.

Figure 6:
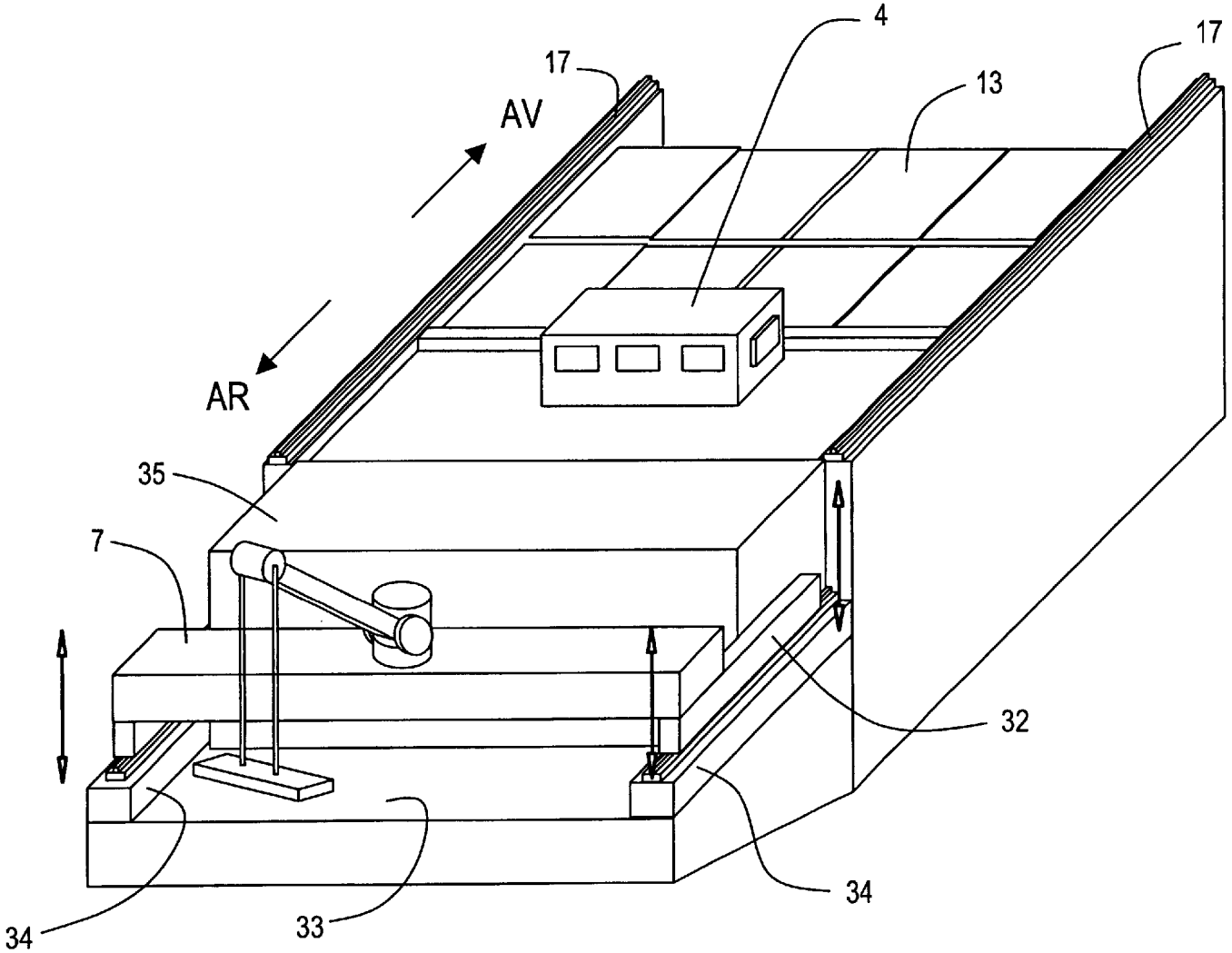

FIG. 6 shows the means for retracting the crane portal according to a first embodiment wherein a special hold 15 designed to receive crane portal 7 is disposed behind bridge 4 in the stern of the ship, said special hold also being dimensioned for stowing containers. A portion of the hull has been cut away for better understanding of the figure.

In this embodiment, on-board handling system 7 is lowered into a hold 15 especially equipped to receive it. This design is applicable only to ships with sufficiently thick sides to receive a lift mechanism.

This hold is preferably located aft, in the area affected by shaping due to the presence of the screws. This optimizes loading volume by reserving the large holds for the cargo.

When the lift is locked in the up position, it can support both the hatch covers of the special hold and either the crane portal or the containers on deck.

The lift 12 has four beams 30 disposed in a rectangle, with the free space between these beams allowing for passage of three standard forty-foot containers. Two of these four beams, disposed in parallel, each support a rail 31. These lateral rails 31 must be mounted on the hatch coaming to ensure continuity with the fixed rails 17, disposed on either side of hold 2, when the lift is in the up position.

Figure 7:
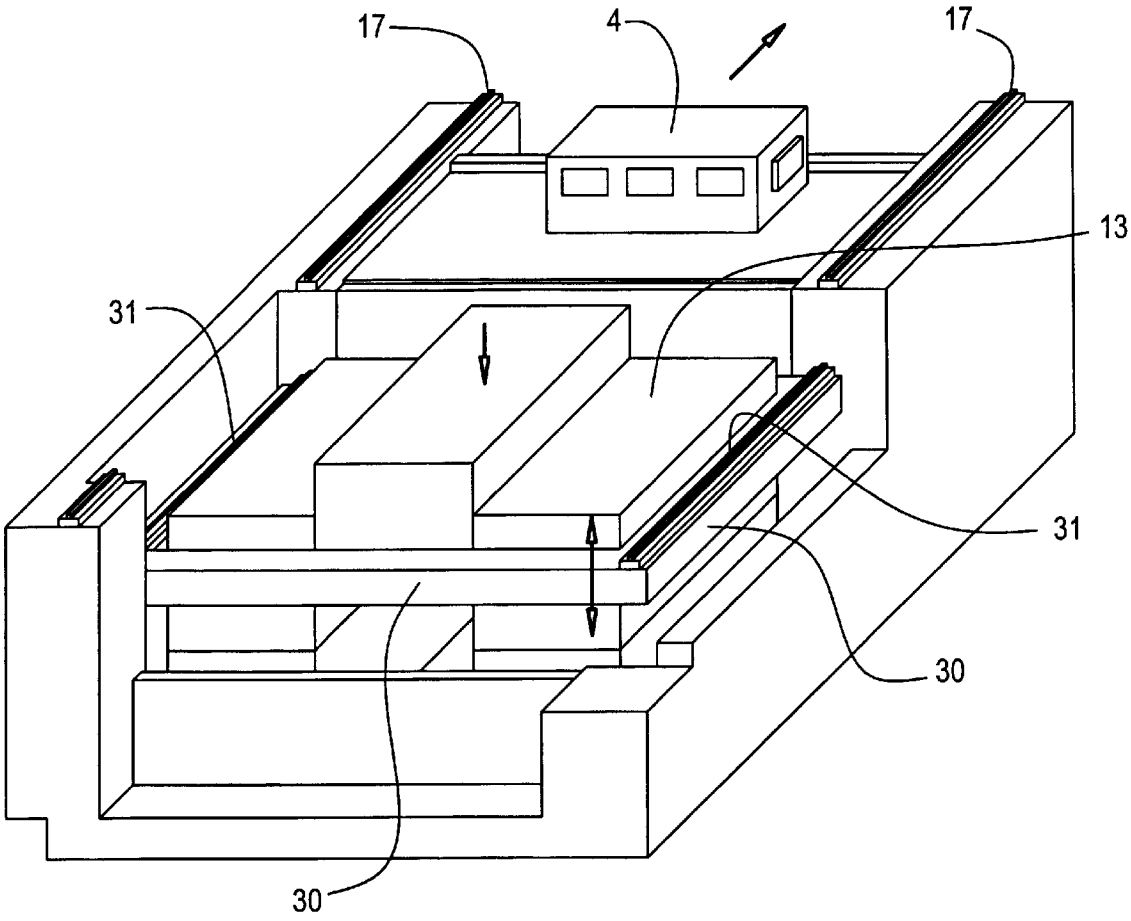

FIG. 7 shows the crane portal retraction means according to a second embodiment wherein a special hold 15 designed to receive crane portal 7 is disposed behind bridge 4, said special hold also being dimensioned for stowing containers.

If the side walls are thin, the crane portal lift system can no longer be installed in the thickness of these sides.

The two lengthwise rail portions 32 are then lowered outside the hull, on the aft area 33 constituting a small deck, at a location where structural constraints are small.

Under these conditions, there is no discontinuity in structure or discontinuity in hatch coaming.

On the other hand, the crane portal must be built to withstand harsh conditions at sea (it is continuously outside) and the aft structure must be specially reinforced to withstand impacts during port and lock maneuvers.

This design is well-suited for ships with a large hold depth relative to the size of the crane.

The lift is made of three beams 34 in an H-shape and a lengthwise rail 32 is disposed on each of the parallel arms of the H and a hydraulic jack, not shown, is disposed on each of these two beams. In the down position, the portal partially surrounds a part 35 of the hull.

In one possible variant, the two portal rails are continuous. The portal itself can then be, as desired: articulated for insertion into a space between the two rails, or rotated through a quarter-turn on a vertical axis.

To achieve the maneuvering autonomy objectives, the container ship also has sufficient maneuverability to dock without the aid of a tugboat or maneuvering gear.

Figure 3:
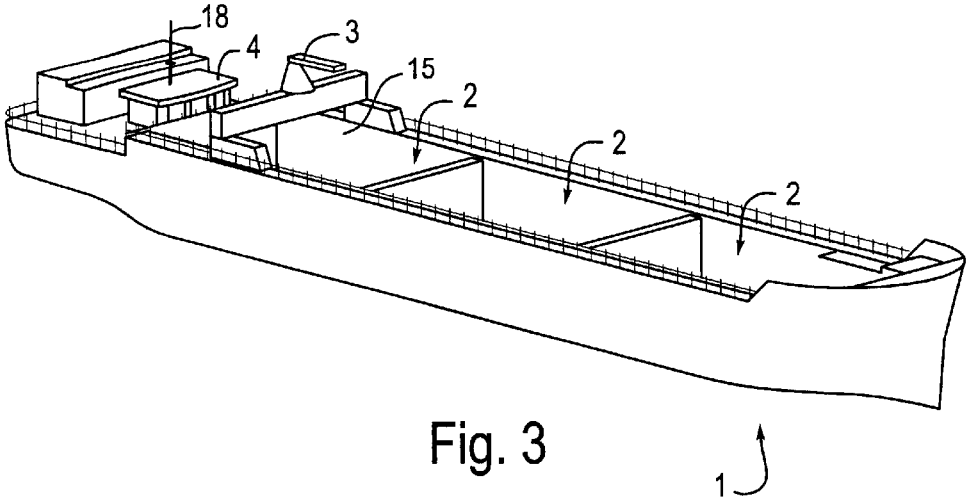
Figure 4:
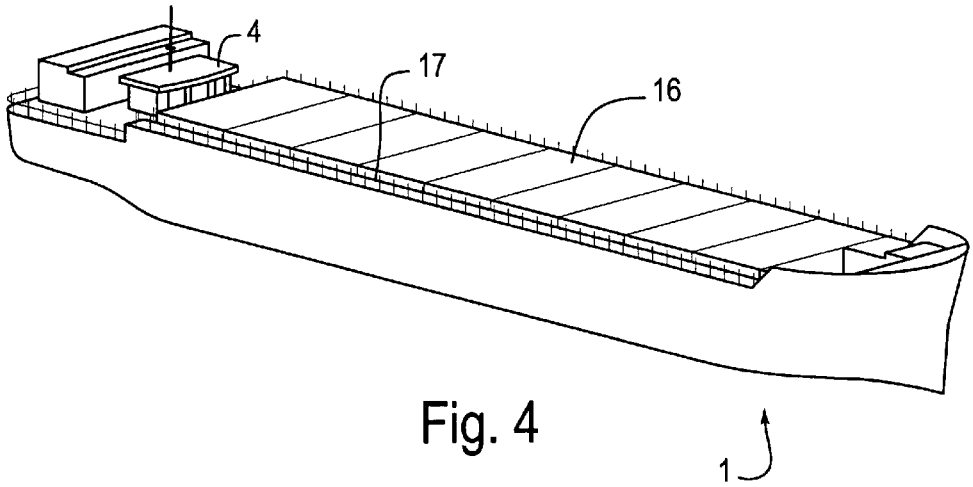

FIG. 4 shows that the ship is provided with watertight hatch covers 16 positioned by handling means 3 either in a deployed position in which they cover almost all of hold 2 or in an accordion-folded position in which the entire hold 2 is accessible by said handling means 3. These covers are not shown in FIGS. 1 to 3 and 5 to simplify these figures.

Special area 15 of hold 2 is covered by watertight hatch covers 16*a* which are motorized. This embodiment of the invention does not provide for handling means 3 to be able to manipulate these covers 16*a* when these means are positioned in special area 15 of hold 2.

Figure 8:
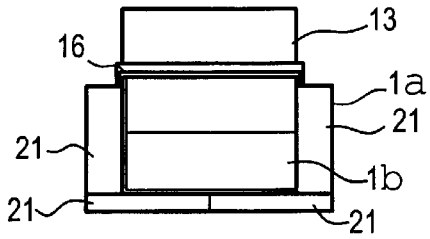
FIG. 8 is a cross section of a ship according to the invention.
Figure 9:
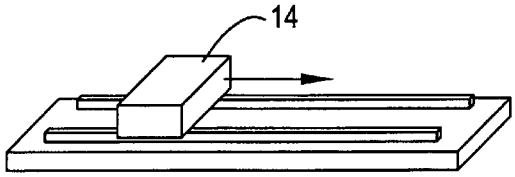
FIG. 9 shows the roll stabilizers of a ship according to the invention.

As shown in FIG. 8, the ship according to the embodiment described has a double hull 1*a,* 1*b*.

Figure 5:
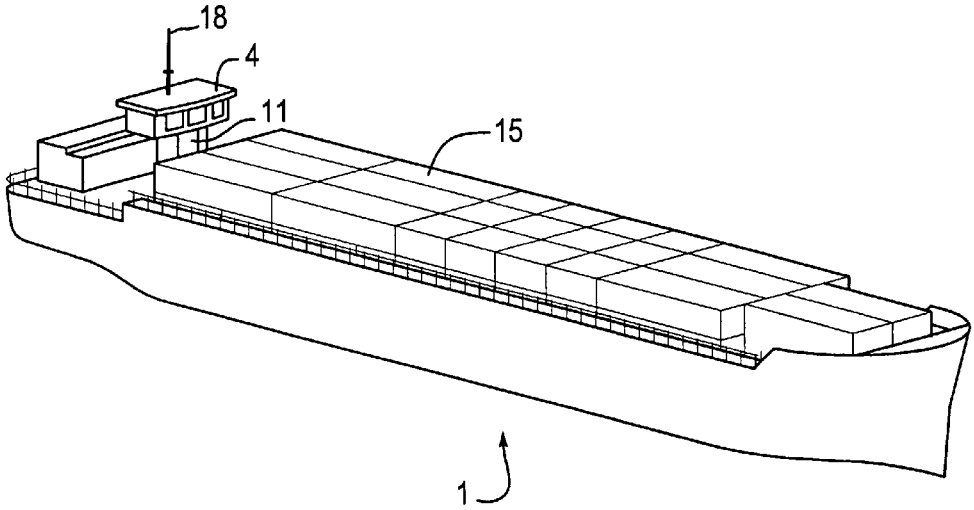

The ship shown in FIGS. 3 to 5 is dimensioned to sail in canals with 12-meter locks.

Its principal dimensions are the following:

| | |
|---|---|
| Length: | 99.90 m |
| Width: | 11.40 m |
| Air draft: | at sea: 8 m<br>in canal: 5.25 m |
| Draft: | at sea: 3.60 m (fully loaded)<br>in canal: 3 m |
| Service speed: | at sea: 12 knots<br>in canal: 6 km/h |
| Its load is: | |
| Containers (number) | in hold: 60 containers, two-high |
| On deck: | 30 containers (at sea only) |
| Namely: deadweight tonnage: | at sea: 1800 tons*<br>in canal: 1200 tons |

*"Tons" are presumably metric tons, but the numbers are sufficiently imprecise that conversion to US tons is probably unnecessary (1 metric ton = 1.102 US tons). Translator.

This ship complies with French shipping legislation: regulation attached to Decree of Nov. 23, 1987 on safety of ships and subsequent amendments thereto.

The general appearance of the ship is hence as follows.

The ship is an ocean-going vessel. It has a double hull 1*a,* 1*b* and watertight hatch covers 16, 16*a*.

Container holds 2 are dimensioned to received 20- to 50-foot ISO containers two-high and three-wide without wasting space.

Figure 10:
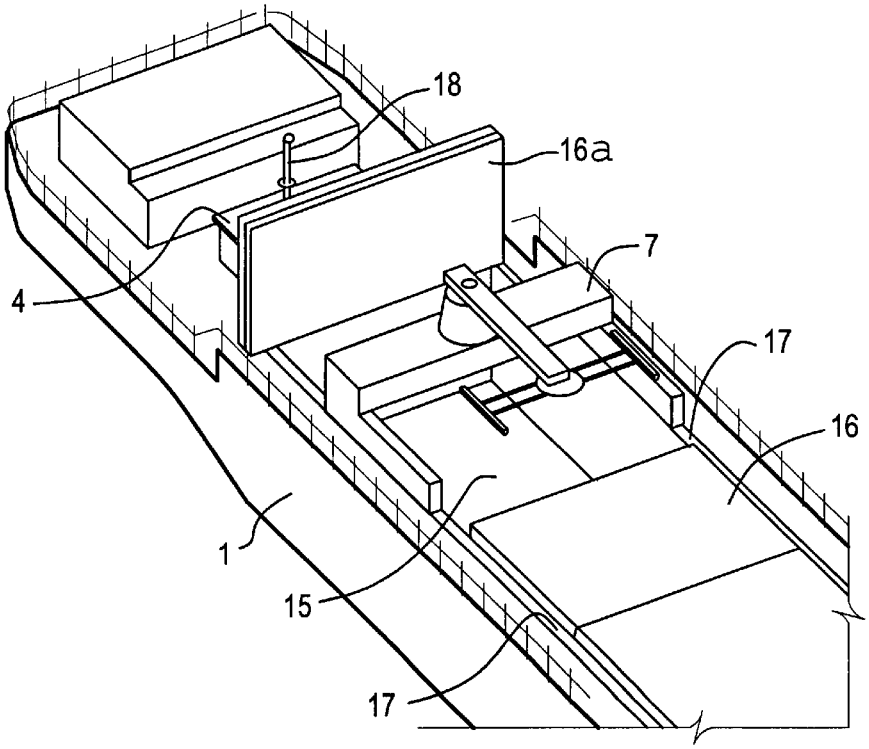
FIGS. 10 and 11 show an embodiment of the handling means used in the framework of the invention.

As shown in FIG. 10, handling means 3 are principally used to manipulate the ISO containers between the edge of the wharf and their spaces in the hold. It is composed of:

a crane portal 7 able to move longitudinally while loaded on two rails 17 located on each side of hold 2, a crane 8, 9 with a reach of about 10 m and a load of 40 tons. Loaded, it can pivot±90° to deposit containers on the wharf alongside the ship, a steerable spreader 10 suspended at the end of the jib for gripping containers 13 by their upper comers according to the ISO standard.

Stabilizing means 14 comprised of a 20-ton weight moving 10 m athwartships compensates for rolling when a container 13 is deposited or picked up.

This system is used for roll control only when a container is being manipulated alongside the ship. Normal stabilizing of the ship is accomplished by the ballasting system.

The land handling system is comprised of a self-propelled truck of a known type, unloaded and loaded by the handling means.

Figure 2:
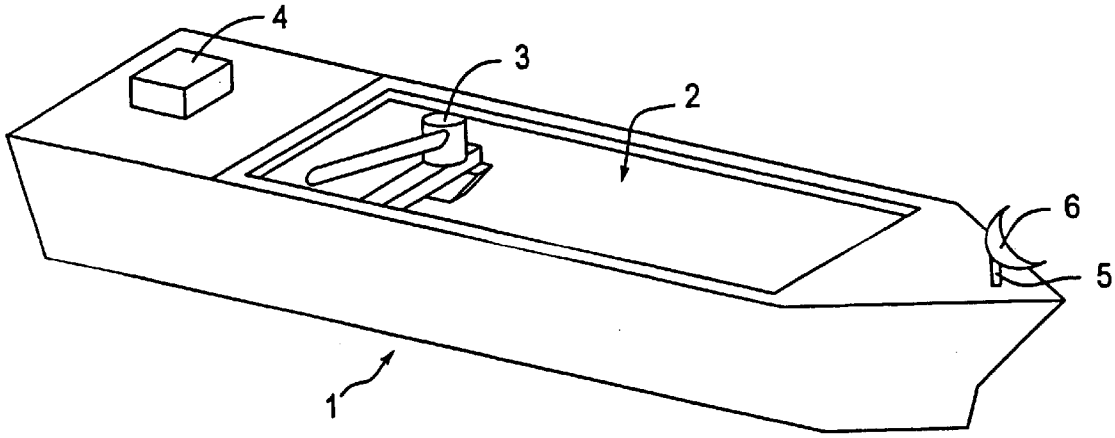

As shown in FIGS. 1 and 2, the portal-crane assembly is retractable into a special area 15 of the aft hold 2 by means of a lift 12.

Advantageously, for space-saving reasons, the land handling system is stowed in the narrower part of the hold at the bow of the ship. It is put on board by the portal crane.

Bridge 4 is mounted on a telescoping mast 11 passing through the area located beneath. The erection mechanism consists of hydraulic jacks or screw jacks. The electrical, hydraulic, etc. connections between the bridge and the ship are preserved during translational movements. Vertical movement is possible during normal operation of the ship.

This telescoping mast 11 enables bridge 4 to be retracted when the ship is sailing on a river or canal so that there is sufficient headroom while, at sea, forward viewing over the on-deck containers is possible, i.e. when a layer of containers is placed on watertight hatch covers 16.

The mast 18 itself can be tilted rearward.

Ballasting means 21 are comprised of ballast tanks located in the double bottom (between the outer skin and the hold). These tanks are built into the structure of the ship. They are sufficient in number to distribute the stabilization: each tank is always either full or empty.

The liquid used for ballasting is the ambient water (seawater or canal water).

The water is moved by high-speed pumps and lines fitted with valves.

The tanks are always fitted with water level sensors.

The ship carries a system for real-time measurement of the bow, stern, and amidship drafts.

This system is comprised of six water level sensors, a concentrator, and repeaters.

Control of the ballasting means and reading of the drafts are centralized (the various valves are grouped together or remote-controlled, and the pump controls are grouped together) to be operable by a small crew in charge of control operations.

In addition to the safety means used for river or canal navigation, there are retracting means, particularly means for retracting bridge 4, and where necessary for retracting the masts carrying the radar detection means.

These safety means comprise a subassembly for measuring the height of an obstacle, particularly a bridge*, and a subassembly for measuring the headroom of the ship or at least the position of the stern mast. These means also include means for comparing these values with each other, associated with an alarm and/or automatic means for adjusting the position of telescoping stern mast 11 as well as that of the other masts if applicable.

Thus, when the air draft is greater than the headroom below the bridge, an audible alarm goes off and/or the position of telescoping mast 11 and the other masts is adjusted such that the air draft of the ship is less than the headroom below the bridge and/or the ship makes an emergency stop.

These ballasting means are dimensioned to compensate for the load permissible in rivers, namely about 1200 tons (±60 twenty-ton containers 13) and the ballasting speed is such that it compensates for loading/unloading operations independently, i.e. with the on-board handling means.

They enable the draft and air draft to be kept constant whatever the load, and compensate for average heeling.

The propulsion system is of the diesel electric type. It has an electric generator, main azimuth thrusters, and a bow thruster.

Moreover, the shore installations necessary are minimized because the only requirements are:

a wharf with a draft of at least 3 meters two dolphins for mooring the ship a flat area for receiving road vehicles.

The wharf can be a simple platform about 20 meters long on pilings able to accept a load of 45 tons.

At sea, the handling means do not need to be retracted. They can either be stowed in their special hold 2, in which case this hold will be equipped with independent hatch covers 16*a*, or kept on deck, when special hold 2 can receive containers 13.

This arrangement has three advantages. It increases loading capacity, preserves handling self-sufficiency, and eliminates motorization of covers 16*a* of the special hold.

In fact, the hatch covers are required only at sea. If the portal crane remains on deck at sea, it can still be used to maneuver the covers over special area 15 of hold 2.

With this assumption, it is preferable to locate the hold reserved for retracted equipment aft of the bridge to preserve the forward view from the bridge, in which case handling means 3 in the nonretracted position could pass over bridge 4 when it is retracted.

Of course, numerous modifications may be made to the embodiment described above without departing from the framework of the invention. Thus, the containers can be unloaded axially, i.e. by the stern or by the bow of the ship, to avoid heeling problems on unloading.

Figure 11:
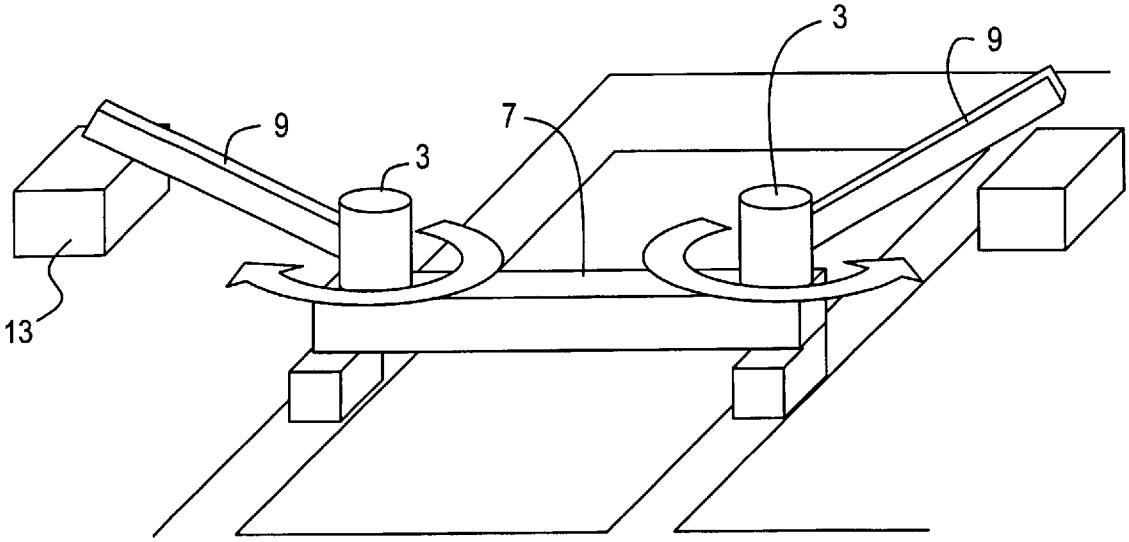

In addition, the handling means may be comprised of a two-crane portal as shown in FIG. 11. These two cranes are placed on either side of the portal. They then have one-third the reach of a central crane. Only the wharf-side crane can deposit a container on the wharf while the other crane handles another container as a counterweight.

Moreover, the propulsion system can use a classical diesel with a drive shaft and steering apparatus of the type with the rudder blade behind the screw.

What is claimed is:

1. An autonomous container ship having a hull, a bridge, propulsion means, at least one hold to receive containers, a device for handling the containers, ballasting means, and a device for retracting the bridge, the autonomous container ship comprising:

at least one water tight hatch cover;

a portal crane, movable on rails, and disposed on a side of the hold; and a retracting device to retract the portal crane into a special area of the hold, the special area also used for storing containers.

2. The autonomous container ship as claimed in claim 1, further comprising:

coaming disposed around the at least one hold so the at least one hold is not flooded; and rails being disposed on said coaming.

3. The autonomous container ship as claimed in claim 1, further comprising a lift to retract the portal crane and at least part of the rails.

4. The autonomous container ship as claimed in claim 1, wherein the special area is disposed aft of the bridge in the stern of the ship.

5. The autonomous container ship as claimed in claim 1, further comprising a retracting device to retract at least one mast which supports a radar detection device.

6. The autonomous container ship as claimed in claim 1, wherein the water tight hatch covers are able to support containers.

7. The autonomous container ship as claimed in claim 1, wherein the water tight hatch covers are manipulated by the portal crane.

8. The autonomous container ship as claimed in claim 1, wherein the water tight hatch covers are disposed over the special area in a deployed position and allow access to the special area in a non-deployed position.

9. The autonomous container ship as claimed in claim 1, wherein:

the hull is a double hull;

the ballasting means includes a plurality of tanks disposed between each hull of the double hulls, the tanks being supplied with water using pumps; and the ballasting means compensates for the variation in draft and associated air draft corresponding to the degree of loading.

10. The autonomous container ship as claimed in claim 1, further comprising an inflatable buoy system including a plurality of inflatable buoys, the inflatable buoys being disposed in at least one side of the ship to increase flotation inertia thus limiting pitching and rolling of the ship.

11. The autonomous container ship as claimed in claim 1, further comprising:

a safety device to determine the clearance between an obstacle and the ship;

a display device to display clearance information;

an alarm which is activated by clearance information; and a controller, activated in response to clearance information, to control the retracting device.

12. An autonomous container ship having a hull, a bridge, propulsion means, at least one hold to receive containers, a handling device to handle the containers, ballasting means, and a retracting device to retract the bridge, the autonomous container ship comprising:

a plurality of water tight hatch covers;

coaming disposed around the at least one hold;

a portal crane, movable on rails, disposed on a side of the hold;

rails disposed on the coaming; and a second retracting device to retract the portal crane.

* * * * *